United States Patent [19]

Källström

[11] Patent Number: 4,723,385

[45] Date of Patent: Feb. 9, 1988

[54] FIRE RESISTANT WALL CONSTRUCTION

[75] Inventor: Krister Källström, Stockholm, Sweden

[73] Assignee: Hadak Security AB, Eskilstuna, Sweden

[21] Appl. No.: 925,966

[22] Filed: Nov. 3, 1986

[30] Foreign Application Priority Data

Nov. 4, 1985 [SE] Sweden ..... 8505193

[51] Int. Cl.[4] ..... E04C 2/08; B27N 9/00

[52] U.S. Cl. ..... 52/173 R; 52/1; 52/404; 428/921

[58] Field of Search ..... 52/173 R, 1, 404, 232; 428/921, 920, 913; 109/24, 23, 49.5, 58, 65, 78

[56] References Cited

U.S. PATENT DOCUMENTS 4,178,727 12/1979 Prusinski et al. ..... 52/173 R
4,263,365 4/1981 Burgess et al. ..... 428/921 X
4,405,682 9/1983 Fujita et al. ..... 428/921 X
4,509,559 4/1985 Cheetham et al. ..... 428/921 X
4,591,532 5/1986 Tanaka ..... 428/921 X

*Primary Examiner*—J. Karl Bell
*Attorney, Agent, or Firm*—Nies, Webner, Kurz & Bergert

[57] ABSTRACT

A fire resistant wall construction incorporating a phase conversion material the phase conversion of which takes place at a temperature below the temperature at which wood, paper etc. is liable to ignite. The phase conversion material includes a mass (2) produced from a mixture of water-glass in liquid phase and water and a binder such as cement or the like, the phase conversion material having a water content of such magnitude that the endothermic reaction taking place during the phase conversion process is essentially constituted by the vaporization of the water present.

11 Claims, 3 Drawing Figures

FIRE RESISTANT WALL CONSTRUCTION

Figure 1:
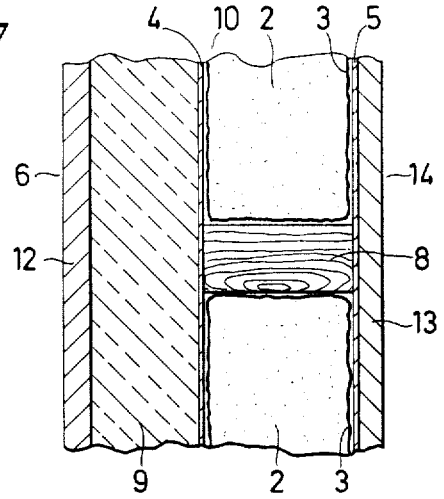

Fire resistant wall constructions are used in several different connections, for example to partition-off different parts of a building, to enclose a stairwell or staircase, to erect fireproof cabinets and cupboards intended for storing equipment and assemblies which are sensitive to high temperatures, for the construction of computer rooms, etc.

In order for a wall to be considered fire resistant, it must be capable of withstanding a given high external temperature for a given period of time before the temperature of the wall interior exceeds a given level. Such requirements vary, of course, from application to application.

Fire resistant walls are normally manufactured from concrete or concrete-based materials, where in building applications walls are erected with a thickness which is sufficient to prevent the interior temperature of the wall from rising above a given level, when the outer surfaces of the wall are subjected to high temperatures. Fire resistant walls that are made of concrete are often heavy and expensive. Another drawback encountered with concrete fire-resistant walls is that their weight often renders it difficult to erect such walls in existing buildings. The need to erect fire resistant walls may arise when part of a building is to accommodate machinery and apparatus which is sensitive to high temperatures, such as computer equipment. Another instance where fire resistant walls constructed in accordance with known techniques are difficult to erect is when movable walls are required, such as, for example, concertina or folding partition walls in hotels, conference rooms and public buildings, where the use of such walls is quite common. The reason why such walls are difficult to install is because of the weight of the concrete wall elements.

The maximum permitted temperature to which the interior of a so-called fire resistant cupboard intended for storing data media, such as computer discs, records, tapes, etc., can be heated when exposed to an external temperature of 1000° C. for a period of 2 hours is 50° C.

The walls of such cupboards, or cabinets, are normally made of concrete, with a layer of insulating material on one side of the concrete and plates placed on both sides of the walls. The concrete wall is built to a thickness such that the thermal conductivity of the concrete, in combination with a certain transference of water from the concrete, will ensure that the inner temperature of the wall, under the influence of the insulating layer, will not exceed the aforesaid value under the conditions mentioned.

The use of conventional concrete therefore results in a thick and heavy wall, as beforementioned.

In order to obtain a temperature delay effect on the inside of a fire resistant cupboard, it has been proposed to incorporate a phase converting material in the cupboard wall, by which is meant a material which exhibits endothermic phase conversion. This phase conversion shall take place at a temperature which is beneath the maximum temperature to which the inner wall surface can be allowed to reach.

Among other things, the International Application WO No. 82/00040 proposed the use of glauber salt, i.e. sodium sulphate decahydrate, which has a phase conversion temperature (melting temperature) of about 32° C., and a further phase conversion temperature (vaporization of water of crystallization) of about 100° C.

Silicate compounds have also previously been used to obtain an endothermic conversion, as disclosed, for example, in the German Published Specification DE-OS No. 2413644. This publication teaches the combination of a layer of silicate compound and a layer of mineral wool.

The U.S. Pat. Specification No, 4,413,869 teaches the use of gypsum, mineral wool, and a mixture of a silicate compound in solid phase, and gypsum in solid phase.

The use of a compound which undergoes endothermic conversion for the purpose of delaying a rise in temperature above the level at which the conversion takes place is therefore well known.

This phase conversion material, however, does not constitute a building construction material per se, and hence the use of such materials must be combined with supporting or load-bearing constructions.

The present invention eliminates the aforementioned drawbacks associated with known techniques and provides a wall element of considerably smaller thickness than known wall elements with which the same performance ability is to be achieved.

The wall element is also considerably lighter than a concrete wall, and hence the weight of a wall constructed with wall elements according to the invention is much lighter than a wall constructed from conventional concrete wall elements.

Thus, the present invention relates to a fire resistant wall construction which incorporates a phase conversion material, the phase conversion of which takes place at a lower level of temperature than a temperature level which is hazardous to wood, paper etc., and which is characterized in that the phase conversion material includes a mass produced from a mixture of water glass in liquid phase, water and a binder, such as cement or the like, said phase conversion material having a water content of such magnitude that the endothermic reaction in the phase conversion process constitutes essentially the vaporization of said water.

Figure 2:
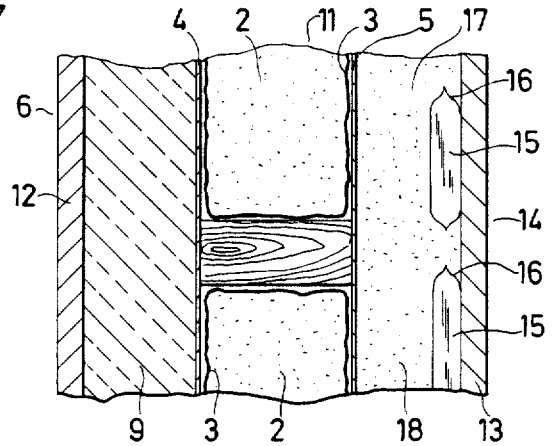
Figure 3:
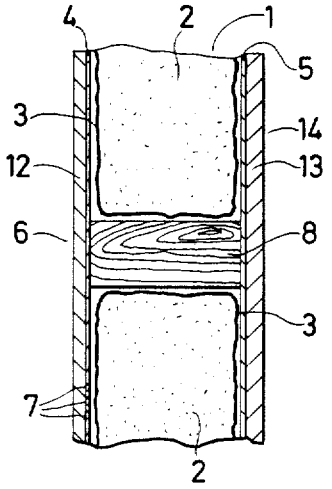

The invention will now be described in more detail with reference to the accompanying drawing, in which FIG. 1 is a cross-sectional view of a wall element according to a first embodiment in which the invention is employed; FIG. 2 is a cross-sectional view of a wall element according to a second embodiment in which the invention is employed; and FIG. 3 is a cross-sectional view of a wall element according to a third embodiment in which the invention is employed.

The present invention is based on an endeavour to obtain a construction material which is suitable for use in fire resistant wall constructions and which contains large quantities of water. When compared with other phase conversion materials known in the present context, water is essentially cost free while, at the same time, comparatively large quantities of energy are required to raise the temperature of the water from room temperature to a temperature in excess of 100° C. In the case of standard, conventional fire resistant wall constructions it is desirable to use a phase conversion material with which phase conversion takes place at a temperature lower than a temperature at which wood, paper etc. is liable to ignite. This desideratum is fulfilled when water is used.

One compound which can contain large quantities of water in gel form is sodium silicate $Na_2O.nSiO_2.pH_2O$. Water-glass is one such compound. Water-glass absorbs large quantities of energy in a temperature range slightly above 100° C. Water-glass containing 60% water increases its heat content by about 1900 kJ/kg from 20° C. to 200° C. Corresponding values for glauber salt are about 2000 kJ/kg.

The increase in the heat content of pure water over a temperature range of 20° C. to 200° C. is roughly 3000 kJ/kg. Thus, in the present context water is more effective than solely water-glass or glauber salt.

Water is thus particularly inexpensive and effective in use. The disadvantage with water, of course, is that it can not, or in all events should not be used in a free state, but must be bound.

According to the present invention there is used a phase conversion material including a mass produced from a mixture of water-glass in liquid phase, water and a binder, such as cement or the like, the phase conversion material having a water content of such magnitude that the endothermic reaction during the phase conversion process is consituted essentially by vaporization of the water.

It has surprisingly been established that such a mass can be produced with a water content as high as 80% or slightly thereabove. Depending upon its water content, the mass varies from a gritty to a gel-like consistency.

According to one embodiment of the present invention, the phase conversion material comprises a mass produced from a mixture of water-glass in liquid phase, cement and water, in which the water is added in a quantity such that the weight of added free water exceeds the total weight of water-glass and cement, but is less than about three times the total weight of water-glass and cement The cement used is preferably Portland cement, although other kinds of cement can be used. It has been found that masonry lime can be used instead of cement.

In accordance with one preferred embodiment of the invention, the ratio between the weight of cement and the weight of water-glass used, preferably a water-glass containing 60% by weight water, is greater than about 0.4.

Two mixing examples are given below. In both of these examples, the first stage of the mixing process was to mix Portland cement with water. This pre-mix served as a curing agent for the liquid water-glass, subsequent to admixing said water-glass with the pre-mix.

EXAMPLE I 15 kg Portland cement and 65 kg water were mixed together to provide a pre-mix, which was then admixed with 20 kg water-glass containing 60% water. Within the space of one minute, the mixture had set to a relatively solid, gel mass. The density of this mass was 1330 kg/m$^3$. The mass contained 77% water.

EXAMPLE II 80 kg Portland cement and 720 kg water were mixed together to form a pre-mix, which was then admixed with 200 kg water-glass containing 60% water. Within the space of six minutes the mixture had hardened to a relatively solid, gel mass. The density of the mass was 1130 kg/m$^3$. Thus, the water content of the mass was as high as 84%.

The curing time, or setting time, for such masses is primarily influenced by the proportion of Portland cement in the mixture. This curing time decreases with increasing proportions of Portland cement. A short curing time is normally beneficial with regard to the technical aspects of production.

As beforementioned, the heat content of water increases by roughly 3000kJ/kg over a temperature range of 20° C. to 200° C.

The mass produced in accordance with Example II above increases its heat content by about 2800 kJ/kg over the temperature range of 20° C. to 200° C. This increase in water content, in combination with the fact that the mixture is particularly inexpensive, renders the mixture particularly suited for use in the present context.

Since the mass has a low mechanical strength, a wall element cannot be built solely from the mass, and hence the wall element must be stiffened or reinforced in some way. The mass, however, is sufficiently strong to be cast, and subsequent to hardening will retain its cast shape even when subjected to a given load.

FIG. 3 illustrates an exemplifying embodiment of a simple wall construction in which the present invention is applied. The reference 1 identifies a wall element which incorporates the aforesaid mass, here referenced 2.

As will be evident from the aforegoing, it is possible to cast the aforesaid mixture and therewith obtain a gel-like mass. However, because of the high water content of the mass, which may reach to about 85%, it is important to prevent the mass from drying-out. This can be achieved by encasing the mass in an impervious casing, such as a plastic foil casing 3, for example a polypropylene foil, or a combination of metal sheet and plastic foil or plastic tape. When manufacturing a wall construction according to the invention, the mixture is therefore cast in plastic foil bags 3 in a shape or form intended for the resultant wall element.

In order to obtain a wall element of sufficiently high mechanical strength, the aforesaid bags, in accordance with one preferred embodiment, are surrounded by thin plates 4,5 which define therebetween a cavity in which the bags are placed. In this regard, the plate located nearest to the ultimate outer surface 6 of the wall element is perforated with a plurality of small holes 7, of which only a few are shown in FIG. 3. The purpose of the holes is to permit steam to penetrate therethrough towards the outer surface of the wall element when this outer surface is subjected to a temperature of such magnitude as to cause the water in the mass to vaporize, causing the bags 3 to burst as a result of the pressure prevailing therein.

Alternatively, the aforesaid casing may comprise steel plates or plates made of some other metal. In this case, the plates are connected together along the corners thereof, or are connected by means of impervious plastic tape to the wooden posts of a stud-work located between the plates. When the wall element is heated to a temperature sufficiently high to vaporize the water in the mass, the plastic tape will burst, enabling vaporized water to escape from the cavity defined by the plates. In those instances when the plates are connected to wooden battens, the battens are provided with holes which are then sealed with an impervious plastic tape.

The embodiment illustrated in FIG. 3 includes a wooden batten 8, which forms a spacer between the plates 4,5. The use of a wooden batten avoids the formation of thermal bridges.

In accordance with one embodiment of the invention, illustrated in FIG. 1, an insulating layer 9 of mineral wool is placed externally of the perforated plate 4, in order to extend the time taken for the phase conversion material 2 to become heated to the temperature prevailing on the outer surface 6 of the wall element.

Naturally, the wall elements 1, 10,11 can be provided with suitable internal and external cladding 12,13, to give the wall the desired appearance. In the case of internal surfaces the cladding 12,13 may comprise sheets of building material onto which wall-paper can be hung, while in the case of external surfaces the cladding may have the form of plaster or bricks.

The aforedescribed wall construction has been found to be particularly effective. For example, in order to provide a two-hour delay before the temperature of the inside 14 of the wall exceeds about 120° C. when the outer surface of the wall is heated to 1000° C., the thickness of the mass in the wall construction illustrated in FIG. 1 need only be about 30 mm, with a mineral wool thickness of 20 mm. Thus, when using building panels 12,13, the thickness of the entire wall is only about 60 mm. The plates 4,5 may have a thickness of 1 mm for example.

The present wall construction therefore eliminates the drawbacks mentioned in the introduction.

In certain cases, such as in the walls of computer rooms or rooms which accommodate other equipment sensitive to elevated temperatures, the temperature on the inner surface 14 of the wall shall not exceed about 50° C. under the aforementioned conditions.

When constructing walls for these purposes, the wall construction, in accordance with a modification of the invention, also incorporates a further phase conversion material, which is spaced from but parallel with the firstmentioned phase conversion material, comprising the aforesaid mass. This further phase conversion material is one with which the phase conversion takes place at a lower temperature than the phase conversion of the mass, namely at a temperature beneath 50° C., this further phase conversion material, in accordance with the invention, being placed closer to the ultimate inner surface 14 of the wall construction.

One serious drawback with the known technique is that thick layers of conventional insulating material must be used, together with relatively thick layers of phase conversion material, due to the fact that there is used solely one phase conversion material, the phase conversion of which takes place at a temperature which is only slightly lower than the highest permitted temperature, or equal thereto.

By combining a layer of said mass with a further phase conversion material with which the phase conversion takes place at a lower temperature, only a relatively small quantity of the further phase conversion material is required while, at the same time, the total thickness of the wall is small in comparison with the case when solely using the further phase conversion material in combination with a thick layer of mineral wool insulation.

The further phase conversion material preferably comprises glauber salt. In addition to being converted at a temperature of above 100° C., glauber salt is also converted at a temperature of about 32° C. Thus, the heat content of glauber salt will increase by 240 kJ/kg over a temperature range of 20° C. to 50° C., and consequently glauber salt can be used efficiently nearest the inner surface of the wall. Corresponding increases in the heat content over the temperature range of 20° C. to 50° C. are also afforded by fixing salt and paraffin.

The last mentioned application is exemplified in FIG. 2.

The further phase conversion material 15 is enclosed in bags 16 made of a flexible and impervious material, preferably a three-ply plastic foil.

For the purpose of holding the bags 16 in position and to isolate said bags from the firstmentioned phase conversion material, the cavity 17 between the plates 5 and the cladding 13, forming the inner surface of the wall, is filled with polyurethane foam 18 or the like, subsequent to positioning the bags.

The wall 11 illustrated in FIG. 2 has been found to be extremely effective. In order that the wall structure is able to withstand an external temperature of 1000° C. for two hours before the temperature of the inner wall surface exceeds 50° C., the thickness of the bags 16, seen from right to left in FIG. 2, may be 10 mm when the total width of the cavity 18 is 20 mm. The thickness of the bags 3 is then 30 mm and the thickness of the mineral wool layer 9 is 20 mm.

When the surface temperature is 1000° C., the heat will have penetrated into the cavity 18 after a given period of time has lapsed. Because a large quantity of this heat is lost in vaporizing the water present in the mass 2, the temperature gradient will fall from 1000° C. to approximately 100° C. over the mineral wool layer 9. In the final stage of a test, i.e. after a lapse of almost 2 hours, the temperature was held at a level of 100° C. at the plate 5 outside the polyurethane layer. Because polyurethane foam has extremely good heat insulating properties, only small quantities of heat are transported therethrough.

Thus, the wall construction according to the invention is comparatively thin in relation to wall elements constructed in accordance with conventional techniques. Because the wall element is relatively thin it is also relatively light in weight. The wall element is also relative inexpensive.

Instead of arranging the bags 16 in the manner illustrated in FIG. 2, the further phase conversion material may be collected at that location of the space to be protected against excessively high temperatures at which the quickest rise in temperature can be expected to occur.

Thus, containers containing bags of the further phase conversion material can be placed in the ceiling of the room to be protected, such as small rooms or various types of fire-proof cabinets. The effect produced hereby fully corresponds with the aforementioned effect, since the phase conversion of the further phase conversion material results in a lowering of the air temperature in the room or space protected. The insulating layer 18, preferably comprising polyurethane foam, is retained in this embodiment.

In addition to walls of computer rooms, the last mentioned wall construction may be used in the walls of document filing cabinets and storage cabinets. In this case, the plates incorporated in the wall element are utilized to secure different wall elements together. The door of the cabinet is also constructed in accordance with the invention.

Folding walls of the aforesaid kind, for example, are suitably constructed from a wall construction substantially in accordance with FIG. 3. In this case, the claddings referenced 12 and 13 preferably have the form of plates which are used load-carrying elements in the folding wall structure.

It will be understood that the present invention can also be applied in other connections where a fire resistant wall construction is required. In addition, the mass according to the invention can be combined with other materials than those described in the examples.

The invention shall not be considered to be limited to the aforedescribed embodiments, and it will be understood that modifications can be carried out within the scope of the following claims.

I claim:

1. A fire resistant wall construction incorporating a phase conversion material, the phase conversion of which takes place at a temperature lower than that at which material such as wood, paper and the like will ignite, characterized in that the phase conversion material includes a mass produced from a mixture of water-glass in liquid phase and water and a binder, such as cement or the like, said phase conversion material having a water content such that the weight of the free water added exceeds the total weight of the water-glass and cement, but is less than approximately three times said total weight of the water-glass and cement, said phase conversion material having a water-glass content such that the weight of the water-glass is approximately equal to or greater than the weight of cement, but is lower than approximately 2.5 times the weight of the cement, which phase conversion material has a water content of such magnitude that the endothermic reaction taking place during the phase conversion process is essentially constituted by the vaporization of the water present, and in that the phase conversion material (2) is enclosed in an impervious enclosure.

2. A fire resistant wall construction according to claim 1, characterized in that a layer of insulating material (9), such as mineral wool, is arranged between the phase conversion material (2) and the ultimate outer surface (6) of the wall element construction, i.e. the wall surface which becomes heated in the event of fire.

3. A fire resistant wall construction according to claim 1, characterized in that the wall construction also incorporates a further phase conversion material (15) which is spaced from but parallel with the firstmentioned phase conversion material (2) and the phase conversion of which further phase conversion material (15) takes place at a lower temperature than the phase conversion of the firstmentioned phase conversion material (2), and which further phase conversion material (15) is intended to be located nearer the ultimate inner surface (14) of the wall construction.

4. A fire resistant wall construction according to claim 3, characterized in that the further phase conversion material (15) comprises a salt which undergoes a phase conversion at a temperature below about 50° C., preferably glauber salt.

5. A fire resistant wall construction according to claim 4, characterized in that the further phase conversion material (15) is enclosed in bags (16) of a flexible and impervious material.

6. A fire resistant wall construction according to claim 5, characterized in that the bags (16) containing said further phase conversion material (15) are placed in the vicinity of the ultimate inner surface (13) of the wall construction; and in that an insulating material, preferably polyurethane foam, is located in a wall section formed by a space (18) between said inner surface (13) and 7. A fire resistant wall construction according to claim 5, wherein said bags are made from a three-ply plastic foil material.

8. A fire resistant wall construction according to claim 1, characterized in that said impervious enclosure is a plastic foil casing (3).

9. A fire resistant wall construction according to claim 8, characterized in that said plastic foil casing (3) is made from polypropylene foil.

10. A fire resistant wall construction according to claim 8, characterized in that when enclosed in said plastic foil casing the enclosed phase conversion material (2) is surrounded by two mutually spaced, parallel thin plates (4,5), of which the plate (4) located nearest the ultimate outer surface (6) of the wall construction (1; 10; 11) is perforated with a plurality of small holes (7).

11. A fire resistant wall construction according to claim 1, characterized in that said impervious enclosure is an impervious sheet metal casing.

* * * * *

UNITED STATES PATENT AND TRADEMARK OFFICE

CERTIFICATE OF CORRECTION

PATENT NO. : 4,723,385

DATED : February 9, 1988

INVENTOR(S) : KRISTER KALLSTROM

It is certified that error appears in the above-identified patent and that said Letters Patent is hereby corrected as shown below:

Column 7, line 37, cancel "element".

Column 8, line 22, after "and" insert --the first mentioned phase conversion material (2).--.

Signed and Sealed this

Twenty-eighth Day of June, 1988

*Attest:*

DONALD J. QUIGG

*Attesting Officer*

*Commissioner of Patents and Trademarks*